US005737857A

United States Patent [19]

Aumann

[11] Patent Number: 5,737,857

[45] **Date of Patent: *Apr. 14, 1998**

[54] PROTECTIVE SHOE

[76] Inventor: Johann Aumann, Bergham 2, D-83052 Bruckmuhl, Germany

[ * ] Notice: The term of this patent shall not extend beyond the expiration date of Pat. No. 5,711,093.

[21] Appl. No.: 611,042

[22] Filed: Mar. 5, 1996

Related U.S. Application Data

[63] Continuation-in-part of Ser. No. 544,754, Oct. 18, 1995.

[30] Foreign Application Priority Data

Nov. 15, 1994 [DE] Germany ..... 9418347 U

[51] Int. Cl.[6] ..... A43C 13/14; A43B 23/07

[52] U.S. Cl. ..... 36/77 R; 36/55

[58] Field of Search ..... 36/10, 12, 55, 36/83, 43, 44, 77 R

[56] References Cited

U.S. PATENT DOCUMENTS

| | | | |
|---|---|---|---|
| 3,953,566 | 4/1976 | Gore | 264/288 |
| 4,187,390 | 2/1980 | Gore | 174/102 R |
| 4,194,041 | 3/1980 | Gore et al. | 428/315 |
| 4,353,173 | 10/1982 | Paquet | 36/77 R X |
| 4,493,870 | 1/1985 | Vrouenraets et al. | 428/245 |
| 4,574,497 | 3/1986 | Jindra | 36/77 R |
| 4,725,481 | 2/1988 | Ostapchenko | 428/213 |
| 4,899,465 | 2/1990 | Bleimhofer et al. | 36/12 X |
| 5,285,546 | 2/1994 | Haimerl | 36/12 X |

FOREIGN PATENT DOCUMENTS

| | | | |
|---|---|---|---|
| 0080710 | 6/1983 | European Pat. Off. . | |
| 0298360 | 3/1994 | European Pat. Off. . | |
| 4000156 | 7/1991 | Germany | 36/55 |

*Primary Examiner*—B. Dayoan
*Attorney, Agent, or Firm*—Gary A. Samuels

[57] ABSTRACT

The invention is to footwear with a rigid protective cap in the toe area between the leg (S) and the porous connection material (V) on the one hand and the lining (L) on the other hand and whose underside goes under the insole (B) over a predetermined width. The porous connection material (V) is connected to the circumference of the insole (B) by an adhesive connection (KN) at its end facing away from the actual leg material (S), at least in the toe area. The footwear can be produced in a simple and inexpensive way.

7 Claims, 3 Drawing Sheets

PROTECTIVE SHOE

CROSS REFERENCE TO RELATED APPLICATIONS

This application is a continuation-in-part of application Ser. No. 08/544,754, filed Oct. 18, 1995, currently pending.

FIELD OF THE INVENTION

The invention relates to footwear.

More specifically, the invention relates to footwear that contains water vapor permeable, waterproof, microporous membrane materials.

BACKGROUND OF THE INVENTION

Due to their vapor permeability the wear properties of such membrane materials are comfortable. Such a membrane material consists, e.g., of expanded polytetrafluoroethylene (PTFE), polyester or a microporous polyurethane coating.

In this footwear application, at least the leg part of the footwear is usually lined with such a membrane material, designated as "functional layer" in the following description, on the inside. A corresponding example is described in printed publication EP-A2-0 080 710. In most cases the lining is formed by a lining material in the form of a laminate which comprises the functional layer and, on its side facing the interior of the shoe, a textile layer.

In such constructions the stitch areas of seams produced when the shoe leg is sewn to the lining and the insole cause the functional layer to be perforated and become permeable to water.

To overcome this problem, the underside of the footwear or the insole and the lower part of the leg which is lined with the functional layer and which may be sewn to the insole is surrounded by an injection molded caoutchuc or plastic sole to form the outsole. In this process the seam which connects the leg, the lining and the insole is enclosed by the caoutchuc or plastic sole. The leg usually consists of leather or a textile fabric, e.g. man-made fibers.

The injection molded plastic sole seals the seam area between the functional layer on the one hand and the leg and insole on the other hand against direct contact with water. However, the aforementioned leg materials, and in particular leather legs, conduct water in their longitudinal extension by capillary action. This means that when the leg area not covered by the plastic sole becomes wet, water will creep along the leg due to this longitudinal conduction effect, up to the seam located inside of the injection molded plastic sole where it can then penetrate the functional layer at the stitch holes.

Usually the functional layer is located on the inside of a laminate which is coated with a protective textile on the side facing the leg and with a lining material on the side facing inwards. Since most shoes are made in mass production, the formation of water bridges can hardly be prevented on the lower end of leg and lining. These may be formed by threads projecting from the cut lining part and extending over the cut end of the functional layer up to the leg material. It is a particular danger when the leg material consists of a textile fabric that the leg end and the lining end are not cut at the same level so that threads or parts of the textile leg material bridge the cut end of the functional layer and form a moisture bridge up to the lining of the shoe.

The lining material of the functional layer facing the inside of the shoe is usually absorbent and water conducting.

Water which has penetrated the shoe along the leg and enters through the seam and/or the above-mentioned water bridges will then creep along the lining into the shoe.

To overcome this problem, printed publication EP-B1-0 298 360 describes the use of waterproof footwear which is provided with a leg, a lining inside the leg with a waterproof and water vapor permeable microporous functional layer, an insole which is sewn to the lower end area of the lining at its circumference and an outsole consisting of a waterproof plastic material which is injection molded to the lower area of the leg. The lower leg area located in the outsole area is sewn to a porous material which can be penetrated by the plastic outsole material, which is in the liquid state during the injection molding process. In this state of the art footwear the actual leg material is cut in the sole area in such a way that it ends at some distance from the lower end of the lining. The end of the actual leg material is connected to the insole and the lower end of the lining is connected through a connection material formed by the porous material; one end of the porous connection material is connected to the actual leg material, but not to the lining, the other end to the lining and the insole through a seam.

This state of the art footwear can be produced in a process which is also disclosed in printed publication EP-B1-0 298 360. In this process the lining is provided with a waterproof and water vapor permeable microporous functional layer, then the lower end of the actual leg material is arranged such that it has a distance in height to the level of the lower end of the lining and prolonged using the porous material as a connection material. Then the lining and the end of the porous connection material facing away from the actual leg material are sewn together at their lower ends and sewn to the circumference of an insole by a seam. Finally the plastic outsole is mounted by injection molding.

According to FIG. 1, a shoe according to EP-B1-0 298 360 has a leg (S) which consists, e.g., of leather or a textile fabric, preferably of plastic. The inside of the leg (S) is lined with a laminate (L) which serves as an inner lining and comprises a waterproof and water vapor permeable functional layer or membrane (M) which is lined with a textile fabric (T) on the side facing the leg (S) and with a lining material (F) on the side facing the interior of the shoe. The lining material and the textile fabric (T) form a mechanical protection for the functional layer (M). The assembly comprising the leg (S) and the laminate (L) is sewn to the edge of an insole (B) on its lower end, the seam is designated as (N). (A) sole (K) consisting of a suitable waterproof plastic is injected to the underside of the insole (B) and the lower area of the leg (S) sewn thereto. The upper edge (0) of the sole (K) is located so high that the seam (N) is enclosed by the sole (K). The seam (N) is thus sealed against direct contact with water.

Water which hits the leg (S) in the area located outside of the sole (K), however, can reach the seam by migrating along the leg on the inside of the sole (K), where it can penetrate seam holes in the functional layer (M) and reach the interior of the shoe.

In footwear as shown in FIG. 2, the leg (S) does not reach up to the insole (B), but the lower leg end has a distance to the insole edge. This distance is bridged by a perforated or porous connection material (V). The outer edge of the connection material (V) is sewn to the inner edge of the leg (S) by a first seam (N1). The laminate (L) is, however, not sewn to the leg (S) at this spot. The other end of the connection material (V) is sewn to the insole (B) by a second seam N2 together with the inner end of the laminate (L).

During the injection molding process of the sole (K), liquid sole material penetrates the pores or holes or loops of the connection material (V) and reaches the outside of the laminate (L), where the stitch holes of the second seam (N2) are sealed by the plastic sole material.

Since the lower leg area is formed by a perforated or porous connection material (V) connected to the actual leg, water conducted by the actual leg cannot reach the seam connecting leg, lining and insole. Therefore not even water bridges formed through the seam and threads or textile pieces bridging the functional layer can have a negative effect because the water conducted by the actual leg cannot reach them.

Although this type of footwear and the process for its production described has proven successful for a wide variety of casual shoes, new problems arise for example when the toe area of footwear needs to be reinforced by a rigid protective cap, e.g. of steel, or a thermoplastic material.

The state of the art principle cannot be applied to a protective shoe with a protective cap because after insertion of the protective cap the outer material is under a very high tension, a Strobel sewing machine cannot be used to sew the connection material to the lining or the insole.

Instead, in a protective shoe usually the lining is Strobel-sewn to the insole at the shoe leg front, then the protective cap is inserted between the lining and the face material, then adhesive is manually spread on both sides of the outer material and finally the outer material is glued to the insole.

SUMMARY OF THE INVENTION

The object of the invention is to provide for footwear with a rigid protective cap arranged in the toe area between the leg (S) and the porous connection material (V) on the one hand and the lining (L) on the other hand and whose underside goes under the insole (B) over a predetermined width; and wherein the porous connection material (V) is connected to the circumference of the insole (B) by an adhesive connection (KN) at its end facing away from the actual leg material (S), at least in the toe area; which can be produced in a particularly simple and inexpensive way.

DETAILED DESCRIPTION OF THE INVENTION

Figure 1:
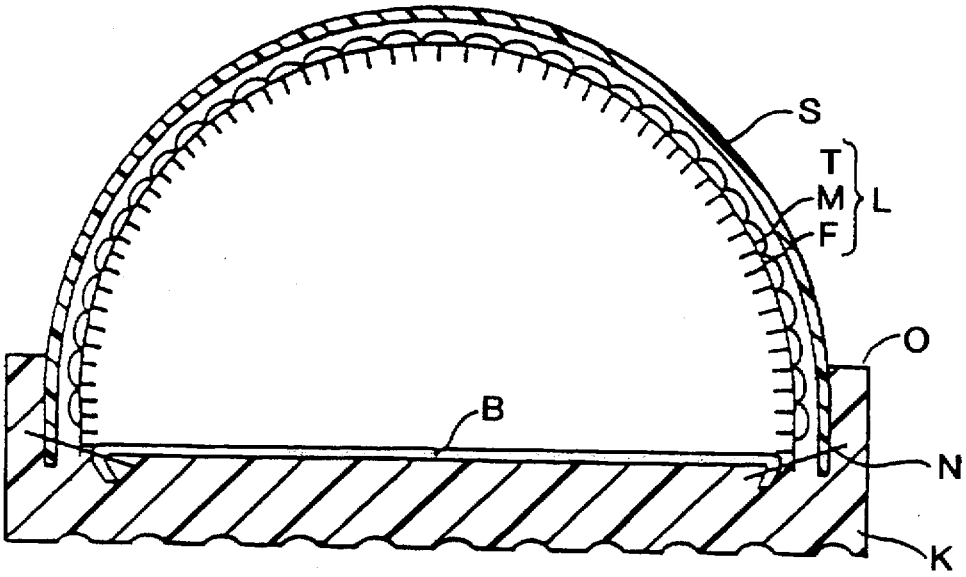
FIG. 1 Prior Art
FIG. 1 shows a cross sectional view through the middle foot area of state of the art footwear.
Figure 2:
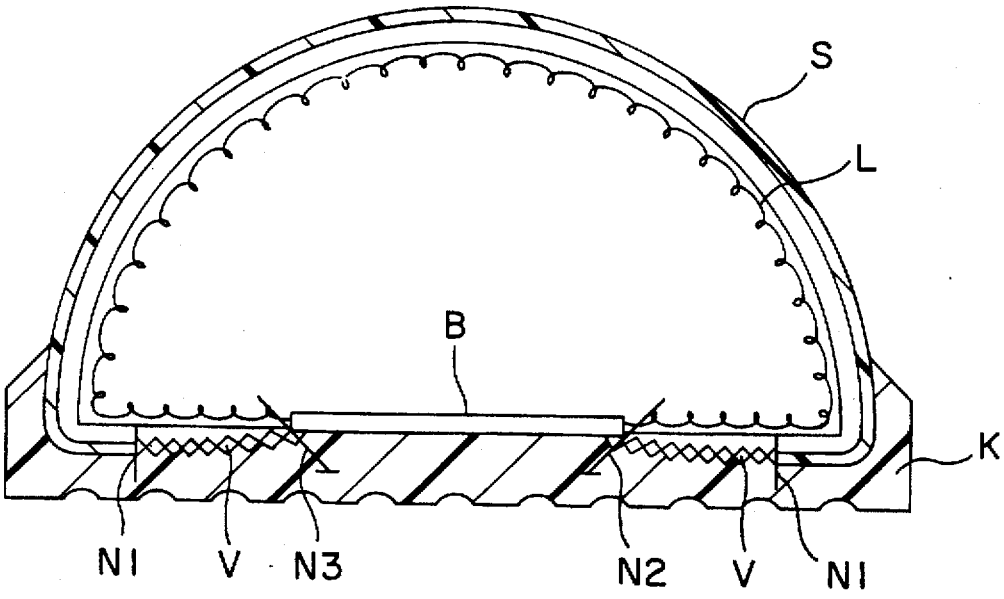
FIG. 2 Prior Art
FIG. 2 shows a cross sectional view through the middle foot area of state of the art footwear.
Figure 3:
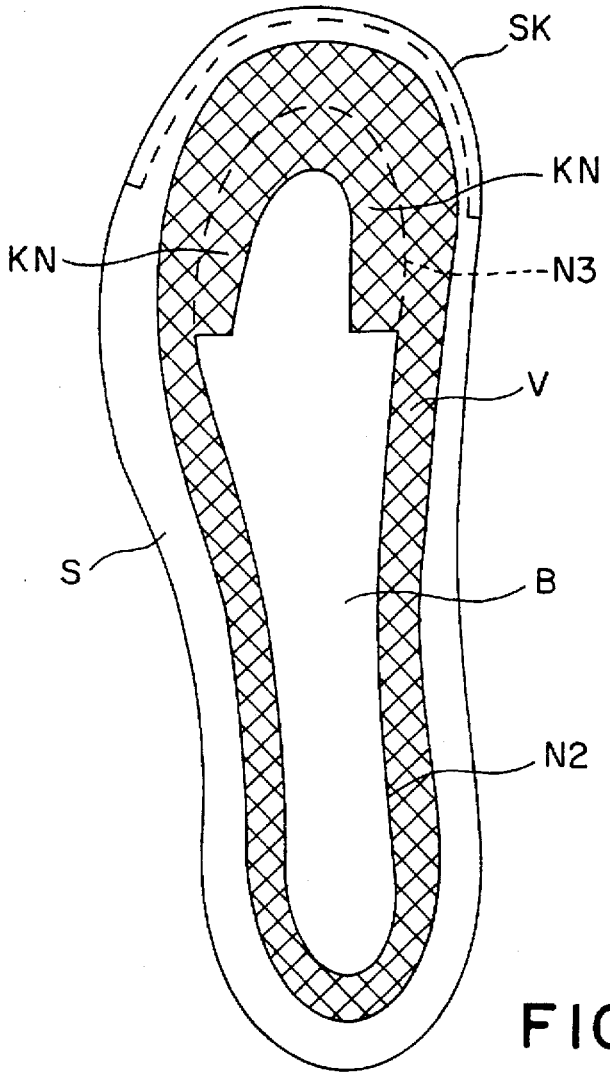
FIG. 3 shows a top view of the underside of the insole of footwear designed according to a first embodiment of the invention.

FIG. 3 shows a top view of the underside of the insole (B) of footwear of a first embodiment of the invention which has the same construction as the footwear shown in FIG. 2 in the middle foot area and the heel area. In the toe area the shoe has a rigid protective cap (SK) between the leg (S) and the lining (L) whose underside, shown in FIG. 3, does not go under the insole (B). The toe area of the lining laminate (L) is sewn or glued to a third seam (N3) on the circumference of the insole (B). In the toe area the porous connection material (V) is guided over the protective cap (SK) and is connected by adhesive lasting with an adhesive connection (KN) on the underside of the insole (B). The adhesive connection (KN) extends over the third seam (N3) towards the middle of the underside of the insole (B). The area (glued area) of the porous connection material (V) extending over the third seam (N3) is glued to the insole (B), e.g. by means of an adhesive bead, whereas the remaining part (sealed area) of the porous connection material (V) is sealed when the outsole (K) is mounted by injection molding. If no waterproof adhesive is used for the glued area it should be ensured that the sealed area remains free from adhesive of the glued area. The porous connection material V is preferably realized as a net tape consisting of monofilic man-made fibers. A loop width of min. 1.5 mm is particularly advantageous. In case of man-made fibers, polyamide or polyester are preferable.

Figure 4:
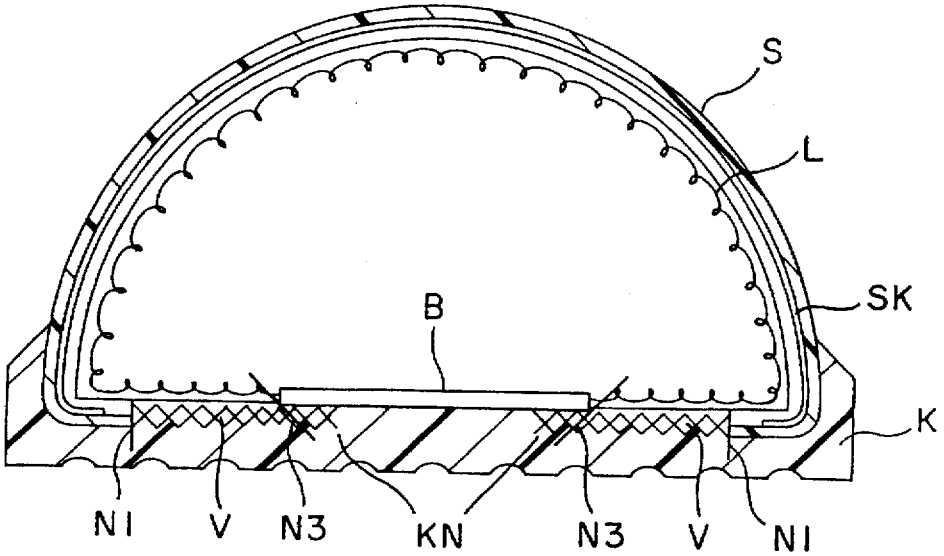
FIG. 4 shows a cross sectional view through a toe area of footwear designed according to the first embodiment of the invention.

FIG. 4 shows a cross section through the toe area of the footwear shown in FIG. 3. The Figure shows that the protective cap (SK) is located between the leg (S) and the lining (L) and that in the toe area the porous connection material (V) extends over the third seam (N3) over the circumferential edge of the insole (B) towards the middle of the insole.

Figure 5:
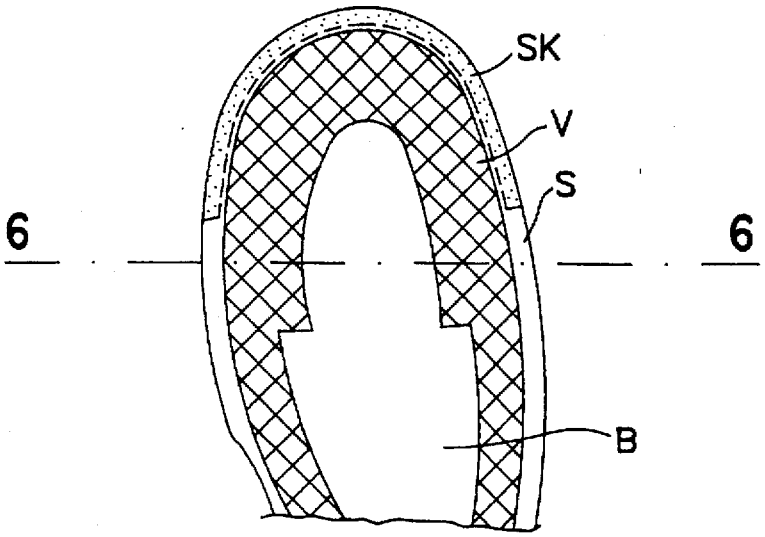
FIG. 5 shows a top view of the underside of a toe area of footwear designed according to a second embodiment of the invention.
Figure 6:
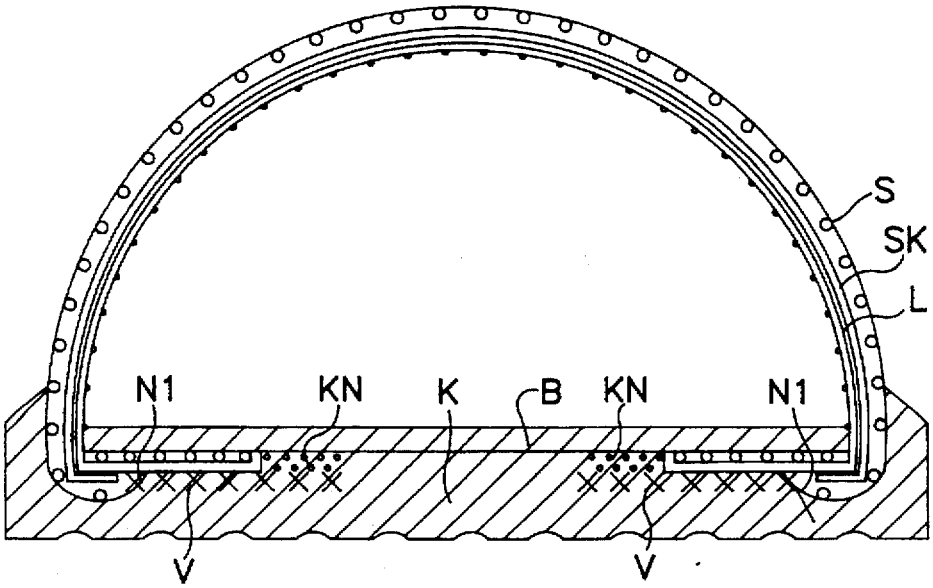
FIG. 6 shows a cross-sectional view through a toe area of footwear designed according to the second embodiment of the invention.

In a second embodiment of the invention shown in FIGS. 5 and 6, the insole (B) extends up to the outer edge of the upper (S) and the actual leg material (S) is pulled over the circumference of the insole up to the underside of the insole (B). The porous connection material (V), preferably in the form of a net, is therefore located fully below the insole (B). This applies both to the toe area comprising the protective cap and to the remaining part of the footwear. Also in this second embodiment, the inner part of the porous connection material (V) extending beyond the inner edge of the lining laminate (L), is connected by adhesive lasting with an adhesive connection (UN) on the underside of the insole (B).

I claim:

1. Footwear with:

(a) a leg;

(b) a lining with a waterproof and water vapor permeable microporous functional layer which lines the leg, (c)an insole which is connected with the lower end area of the lining;

(d) a waterproof outsole which consists of plastic and which is injection molded to the lower area of the leg;

(e) wherein the actual leg material ends at a distance from the lower end of the lining;

(f)wherein the end of the actual leg material is connected to the insole and the lower end of the lining through a porous material which can be penetrated by the outsole material which is still liquid during the injection molding process and which forms a connection material;

characterized by:

(g) a rigid protective cap which is arranged in the toe area between the leg and the porous connection material on the one hand and the lining on the other hand; and (h) wherein the porous connection material is connected to the circumference of the insole by an adhesive connection at its end facing away from the actual leg material, at least in the toe area.

2. Footwear of claim 1, characterized in that the porous connection material which connects the leg to the end of the lining is a net of monofilic man-made fibers.

3. Footwear of claim 2, characterized in that the loop opening size is at least in the range of 1.5 mm.

4. Footwear of claim 2 or 3, characterized in that the material of the net is selected from the group comprising polyamide and polyester.

5. Footwear of claim 4, characterized in that; the lower end area of the lining is sewn or adhesively bonded to the insole.

6. Footwear of claim 5, characterized in that the insole and the end of the porous material facing away from the actual leg material are connected with each other by a Strobel seam.

7. Footwear of claim 6, characterized in that the porous connection material is wider in the toe area comprising the protective cap area than outside of the toe area.

* * * * *